US008434394B1

(12) United States Patent
Malejko et al.

(10) Patent No.: US 8,434,394 B1
(45) Date of Patent: May 7, 2013

(54) APPARATUS FOR ADAPTING A ROCKET-ASSISTED PROJECTILE FOR LAUNCH FROM A SMOOTH BORE TUBE

(75) Inventors: Gregory Malejko, Hackettstown, NJ (US); Daniel Pascua, Ledgewood, NJ (US); Peter Burke, Succasunna, NJ (US); Keith Fulton, Stroudsburg, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 357 days.

(21) Appl. No.: 12/580,412

(22) Filed: Oct. 16, 2009

Related U.S. Application Data

(60) Provisional application No. 61/106,724, filed on Oct. 20, 2008.

(51) Int. Cl.
*F41F 3/00* (2006.01)
*F42B 15/00* (2006.01)

(52) U.S. Cl.
USPC ..... 89/1.816; 102/374

(58) Field of Classification Search ..... 89/1.8, 89/1.816; 102/374, 377, 376, 378, 380, 381, 102/370; 244/3.23, 3.3
See application file for complete search history.

(56) References Cited

U.S. PATENT DOCUMENTS

| | | | | | |
|---|---|---|---|---|---|
| 2,112,758 | A | * | 3/1938 | Blacker | 102/517 |
| 2,661,692 | A | * | 12/1953 | Vegren | 60/201 |
| 2,801,586 | A | * | 8/1957 | Mongello | 102/529 |
| 2,849,955 | A | * | 9/1958 | Smathers | 244/3.23 |
| 2,862,447 | A | * | 12/1958 | Lyon | 244/3.23 |
| 2,968,245 | A | * | 1/1961 | Sutton et al. | 244/3.23 |
| 3,098,447 | A | * | 7/1963 | Hosli | 244/3.23 |
| 3,367,112 | A | * | 2/1968 | Mainhardt | 60/201 |
| 3,390,850 | A | * | 7/1968 | Dahlke et al. | 244/3.23 |
| 3,724,781 | A | * | 4/1973 | Makow | 244/3.23 |
| 3,758,052 | A | * | 9/1973 | McAlexander et al. | 244/3.14 |
| 3,952,664 | A | * | 4/1976 | Schmidt et al. | 60/256 |
| 3,970,004 | A | * | 7/1976 | Suter | 102/476 |
| 4,938,112 | A | * | 7/1990 | Hertzberg et al. | 89/7 |

* cited by examiner

*Primary Examiner* — Michael Carone
*Assistant Examiner* — Reginald Tillman, Jr.
(74) *Attorney, Agent, or Firm* — Henry S. Goldfine

(57) ABSTRACT

An apparatus for adapting a rocket-assisted artillery projectile of a first caliber for firing from a smooth bore tube of a second caliber may include an adapter for connecting to an aft end of the rocket-assisted artillery projectile. The adapter may include a main channel for receiving rocket exhaust, a plurality of sub-channels that lead from the main channel to an exterior of the adapter, and an ignition channel that leads from the main channel to an ignition delay disposed in the adapter. A tail boom may be fixed to an aft end of the adapter. The tail boom may include an opening in a fore end that communicates with the ignition delay in the adapter. Lifting surfaces, such as fins, may be attached to the tail boom.

11 Claims, 2 Drawing Sheets

APPARATUS FOR ADAPTING A ROCKET-ASSISTED PROJECTILE FOR LAUNCH FROM A SMOOTH BORE TUBE

CROSS-REFERENCE TO RELATED APPLICATIONS

This application claims the benefit under 35 USC 119(*e*) of U.S. provisional patent application 61/106,724 filed on Oct. 20, 2008, which is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates, in general, to munitions, and, in particular, to projectiles that may be launched from tubes having smooth bores.

Artillery weapons may fire spin-stabilized projectiles. The projectiles may be launched from rifled tubes, which impart high spin rates to the projectiles. These types of projectiles maintain a stable flight because of their high spin rate, which keeps them gyroscopically stable. These projectiles may not be fired from a smooth bore tube because they lack stabilizing surfaces for static stability.

The precision of mortar and artillery projectiles may be greatly improved by retrofitting the projectiles with guidance kits. These guidance kits, however, may not extend the range of the projectiles. Most of the guidance kits may shorten the maximum possible range, because of a heavier launch weight and increased aerodynamic drag. A need exists for a method of adapting a standard artillery projectile (normally spin-stabilized) for firing from a smooth bore tube, such as a mortar tube, while meeting the requirements of precision and extended range.

SUMMARY OF THE INVENTION

It is an object of the invention to provide an apparatus for converting a standard spin-stabilized projectile into a projectile suitable for firing from a smooth bore tube.

One aspect of the invention is an apparatus for adapting a rocket-assisted artillery projectile of a first caliber for firing from a smooth bore tube of a second caliber. The first caliber may be smaller than the second caliber.

The apparatus may include an adapter for connecting to an aft end of the rocket-assisted artillery projectile. The adapter may include a main channel for receiving rocket exhaust and a plurality of sub-channels that lead from the main channel to an exterior of the adapter. An ignition channel may lead from the main channel to an ignition delay disposed in the adapter. A tail boom may be fixed to an aft end of the adapter. The tail boom may include an opening in a fore end that communicates with the ignition delay in the adapter. Lifting surfaces may be attached to the tail boom.

Another aspect of the invention is a rocket-assisted projectile for firing from a smooth bore tube. The projectile may include a projectile body containing rocket propellant and an adapter fixed to an aft end of the projectile body. The adapter may include a main channel for receiving rocket exhaust from the projectile body and a plurality of sub-channels that lead from the main channel to an exterior of the adapter. An ignition channel may lead from the main channel to an ignition delay disposed in the adapter. A tail boom may be fixed to the adapter. The tail boom may include an opening in a fore end that communicates with the ignition delay in the adapter. Lifting surfaces may be attached to the tail boom.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

By way of example only, an embodiment of the invention will be described in relation to a 105 mm, M913 Rocket-Assisted Projectile (RAP). However, the invention described herein may be applied to many other projectiles.

To improve the precision of artillery shells such as the M913, a guidance kit with fuzing functions (such as the Precision Guidance Kit, or PGK) may be used. The guidance kit may replace the fuze that is located on the forward end of the projectile. The guidance kit may include canards that may help steer the projectile to its target. One embodiment of the present invention may be used to adapt a PGK-equipped M913 projectile for firing from a smooth bore 120 mm mortar.

The invention may make the projectile more statically stable. Static stability is important because a smooth bore mortar tube does not impart any spin to the projectile. That is, the projectile may not be gyroscopically stabilized when fired from a smooth bore tube. The invention may provide for exhausting gases from the existing rocket motor; for incorporating a rocket motor ignition delay; for obturating the gun gases behind the projectile; and for preventing excessive balloting of the projectile in the tube. The body of the normally spin-stabilized projectile may have a smaller caliber or diameter than the caliber or diameter of the smooth bore tube.

Figure 1:
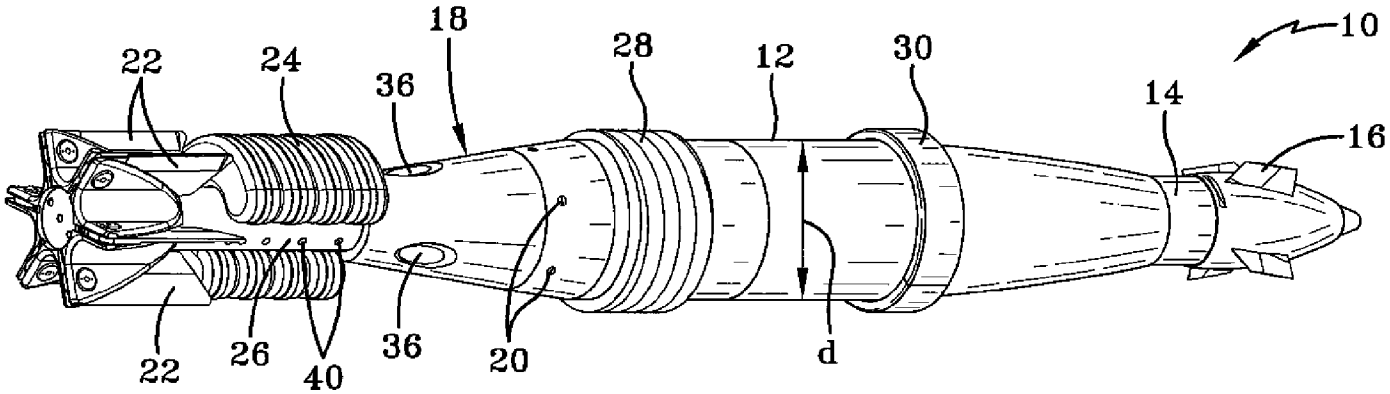
FIG. 1 is a perspective view of an embodiment of a projectile in a pre-flight condition.
Figure 2:
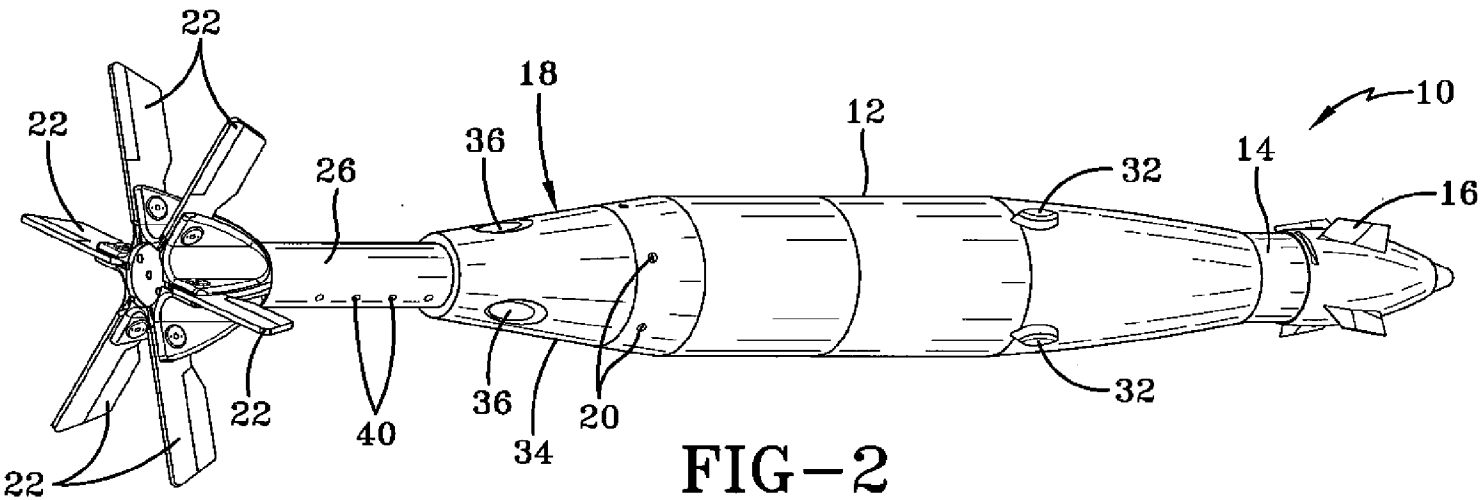
FIG. 2 is a view of the projectile of FIG. 1 in a flight condition.

FIG. 1 is a perspective view of one embodiment of a projectile 10 in a pre-flight condition. Projectile 10 may include a projectile body 12, for example, an M913 projectile body. The fore end of projectile 10 may include a PGK 14. The aft end of projectile 10 may include lifting surfaces, for example, fins 22. In FIG. 1, the fins 22 are in a folded position. Propellant increments 24 may be disposed on a tail boom 26 (FIG. 2). An adapter 18 may be connected to the aft end of projectile body 12 using, for example, fasteners 20, such as pins or screws.

An obturator band 28 may be disposed on an aft end of projectile body 12. The obturator band 28 may be made of a plastic material. Obturator band 28 may act as a seal between the projectile body 12 and the gun tube. The band 28 may remain on the projectile 10 until it exits the gun tube. After exiting the gun tube, the band 28 may be discarded, in a manner similar to the obturator used on conventional 120 mm mortar ammunition.

Figure 5:
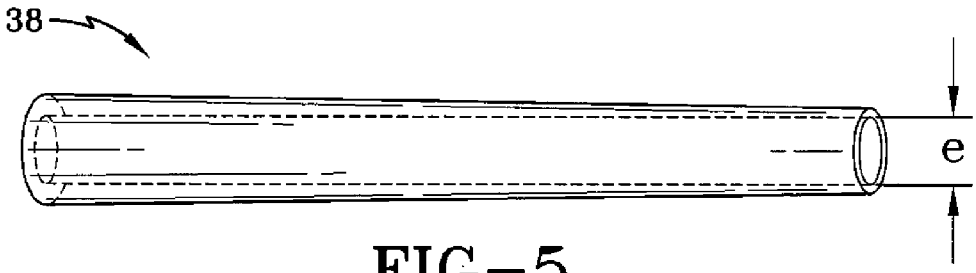
FIG. 5 is a schematic view of a smooth bore gun tube.

The projectile body 12 may have an outside diameter or caliber d. A smooth bore gun tube 38 (FIG. 5) may have an inside diameter or caliber e. Caliber e may be larger than caliber d. Thus, there may be a need to prevent excessive balloting of the projectile 10 in the gun tube. A means for preventing excessive balloting of the projectile 10 in the gun tube may include a bore rider 30, which may be a generally circular band that is placed on the fore end of the projectile body 12. The bore rider 30 may be made of a plastic material. The bore rider 30 may be discarded after exit from the gun tube, to help reduce the aerodynamic drag of the projectile 10 in free flight. By way of example, the caliber d of the projectile body 12 may be about 105 mm and the caliber e of the gun tube 38 may be about 120 mm.

Another means for preventing excessive balloting of the projectile 10 in the gun tube may include a plurality of nubs 32 (FIG. 2) or short projections disposed around the circumference of the fore end of the projectile body 12. Nubs 32 may be made of, for example, a plastic or a soft metal material. Nubs 32 may remain attached to the projectile 10 throughout its flight. For retrofitting existing M913 projectiles or other projectiles, nubs 32 may be affixed to the projectile body 12 by, for example, gluing, epoxying, welding, etc.

FIG. 2 is a view of the projectile 10 of FIG. 1 in a flight condition. In FIG. 2, the fins 22 have been deployed (unfolded) and the obturator band 28 has been discarded. The tail boom 26 may be a conventional tail boom found on mortar rounds. As is known in the art, the interior of the conventional tail boom 26 may include an ignition cartridge (not shown). The ignition cartridge generates gas that passes through openings 40 in the tail boom 26. The gas that passes through the openings 40 ignites the propellant increments 24 (FIG. 1).

The exterior surface of the adapter 18 may taper from the aft end of the projectile body 12 to a smaller diameter using a boattail 34. A plurality of nozzles 36 disposed in the adapter 18 may exhaust the rocket motor gases. FIGS. 1 and 2 show folding fins 22. However, any type of lifting surfaces may be employed for stabilizing the projectile 10 in flight.

Figure 3:
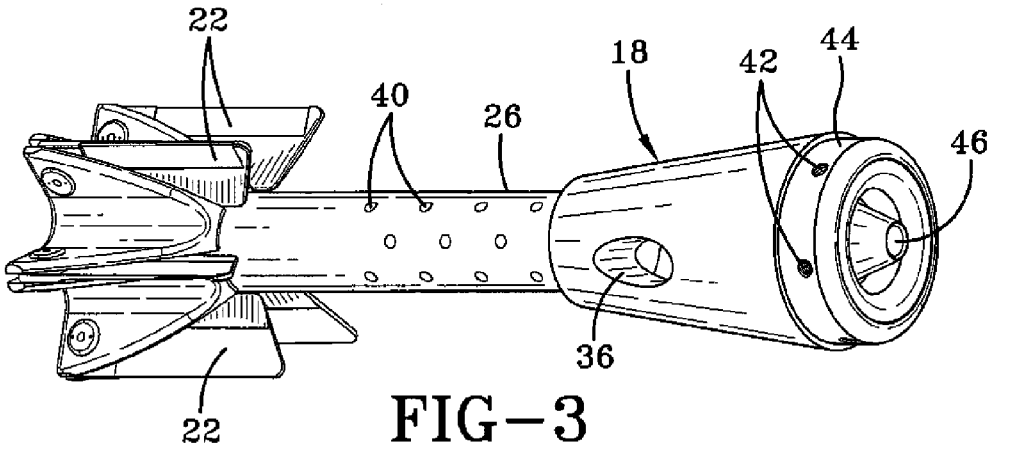
FIG. 3 is a perspective view of a portion of the projectile of FIG. 1.

FIG. 3 shows the adapter 18, tail boom 26, and fins 22. Openings 42 in adapter 18 may receive fasteners 20 (FIGS. 1 and 2). A mating surface 44 of adapter 18 may fit snugly into the aft end of the projectile body 12. Rocket motor exhaust gases may enter the adapter 18 through a port 46.

Figure 4:
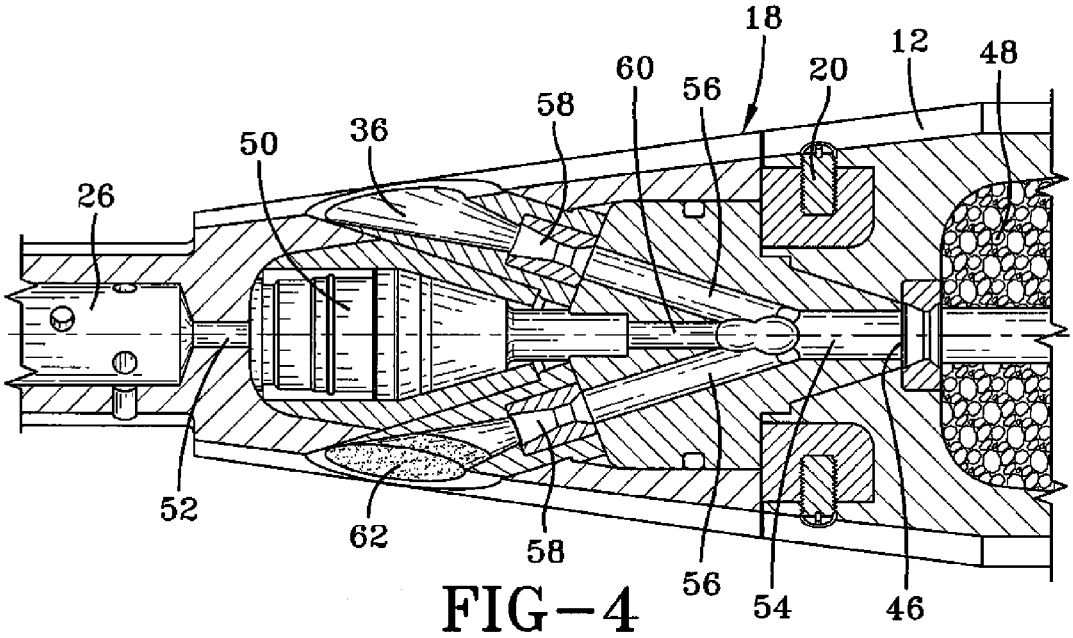
FIG. 4 is a cut-away, enlarged view of a portion of the projectile of FIG. 1.

FIG. 4 is a cut-away, enlarged view showing the adapter 18. The adapter 18 is shown fixed to the projectile body 12 using the fasteners 20. The rocket motor propellant 48 may be disposed in the projectile body 12. The rocket motor in the projectile body 12 may be ignited with an ignition delay device 50, such as, for example, a standard M913 pyrotechnic ignition delay. The ignition delay 50 may be lit using gases generated by the tail boom ignition cartridge. Gases generated by the ignition cartridge in the tail boom 26 may pass through the opening 52 (FIG. 4) in the fore end of the tail boom 26, and then into the ignition delay 50.

After the rocket motor is lit, the rocket motor gases may enter the port 46 in the adapter 18. Port 46 may lead to a main channel 54. A plurality of sub-channels 56 may branch off the main channel 54. An ignition channel 60 may connect the ignition delay 50 and the aft end of the main channel 54. Each sub-channel 56 may include a throat section 58 upstream of a nozzle 36. The throat section 58 may be made of, for example, graphite. The main channel 54 and the sub-channels 56 may be, for example, cylindrical. However, the main channel 54 and the sub-channels 56 may have other shapes that may enhance the performance of the rocket motor.

Tapered plugs 62 may be inserted into the nozzles 36 to prevent propellant gases (from the propellant increments 24 shown in FIG. 1) from entering the rocket motor cavity and prematurely igniting the rocket motor. The plugs 62 may be expelled when the rocket motor ignites and high pressure gases pass through the main channel 54 and the sub-channels 56. By way of example, the port 46, main channel 54, sub-channels 56, and ignition channel 60 may be a single piece, such as a ceramic insert.

Thus, an existing rocket-assisted artillery projectile, which is normally spin-stabilized and fired from a rifled gun tube, may be retrofitted in accordance with the invention to produce a projectile that is suitable for firing from a smooth bore gun tube.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. In a smooth bore gun tube of a second caliber, an apparatus combinable with a rocket assisted artillery projectile of a first caliber, which is smaller than the second caliber, rendering said apparatus-rocket assisted artillery projectile combination firable from said smooth bore gun tube of said a second caliber, the apparatus comprising:

an adapter for connecting to an aft end of the rocket assisted artillery projectile, the adapter including a main channel for receiving rocket exhaust, a plurality of sub-channels that lead from the main channel to an exterior of the adapter, and an ignition channel that leads from the main channel to an ignition delay disposed in the adapter;

a tail boom fixed to an aft end of the adapter, the tail boom including an opening in a fore end that communicates with the ignition delay in the adapter;

the tail boom containing an ignition cartridge;

propellant increments on said tail boom ignited by said ignition cartridge for propelling the adapter-rocket assisted artillery projectile combination out of the smooth bore tube; and wherein gases generated by the ignition cartridge pass through the opening in the fore end to light the ignition delay; and wherein the ignition delay will subsequently ignite a rocket motor in said rocket assisted artillery projectile after said adapter-rocket assisted artillery projectile combination has exited out of the smooth bore tube.

2. The apparatus of claim 1, further comprising an obturator band for placement on the aft end of the rocket assisted artillery projectile.

3. The apparatus of claim 1, further comprising means for preventing balloting of the rocket assisted artillery projectile in the smooth bore tube of the second caliber.

4. The apparatus of claim 3, wherein the means for preventing balloting includes a generally circular band for placement on a fore end of the rocket assisted artillery projectile.

5. The apparatus of claim 3, wherein the means for preventing balloting includes a plurality of nubs for circumferential placement on a fore end of the rocket assisted artillery projectile.

6. The apparatus of claim 1, wherein exit portions of the sub-channels include nozzles.

7. The apparatus of claim 6, wherein the sub-channels include throats located upstream of the nozzles.

8. The apparatus of claim 6, further comprising plugs disposed in the nozzles.

9. The apparatus of claim 7, wherein the throats comprise graphite.

10. The apparatus of claim 1, wherein the first caliber is about 105 mm and the second caliber is about 120 mm.

11. The apparatus of claim 1, wherein folding fin lifting surfaces are attached to the tail boom.

* * * * *